US006059205A

United States Patent [19]

Ricco

[11] Patent Number: 6,059,205

[45] Date of Patent: May 9, 2000

[54] SEALING DEVICE BETWEEN TWO CAVITIES AT DIFFERENT PRESSURES, FOR EXAMPLE, IN AN INTERNAL COMBUSTION ENGINE FUEL INJECTOR

[75] Inventor: Mario Ricco, Bari, Italy

[73] Assignee: Elasis Sistema Ricerca Fiat Nel Mezzogiorno Societa Consortile per Azioni, Pomigliano d'Arco, Italy

[21] Appl. No.: 09/112,907

[22] Filed: Jul. 9, 1998

[30] Foreign Application Priority Data

Jul. 11, 1997 [IT] Italy ..... TO97A0619

[51] Int. Cl.[7] ..... B05B 1/30

[52] U.S. Cl. ..... 239/585.1; 251/30.01; 251/33

[58] Field of Search ..... 239/533.2, 585.1, 239/585.2, 585.3, 585.4, 585.5; 251/30.01, 30.05, 33, 363, 900; 277/511, 614, 910

[56] References Cited

U.S. PATENT DOCUMENTS 4,946,106 8/1990 Turchi et al. ..... 239/585.1

5,067,658 11/1991 De Matthaeis et al. ..... 239/585.1

5,483,991 1/1996 D'Agostino et al. ..... 251/363

FOREIGN PATENT DOCUMENTS 0483770 5/1992 European Pat. Off. .

*Primary Examiner*—Andres Kashnikow
*Assistant Examiner*—Lisa Ann Douglas
*Attorney, Agent, or Firm*—Ladas & Parry

[57] ABSTRACT

The injector has a hollow body carrying a nozzle, and a metering valve having a valve body housed in a cylindrical seat of the hollow body. The valve body has a distribution cavity for distributing high-pressure fuel to a control chamber of the valve, whereas the seat communicates with a cavity at atmospheric pressure and in which the control rod slides. The sealing device has an annular seal, which is compressed between two shoulders carried by the surface of the seat and by an outer surface of a portion of the valve body so as to provide for redundant sealing between the two surfaces.

5 Claims, 2 Drawing Sheets

SEALING DEVICE BETWEEN TWO CAVITIES AT DIFFERENT PRESSURES, FOR EXAMPLE, IN AN INTERNAL COMBUSTION ENGINE FUEL INJECTOR

BACKGROUND OF THE INVENTION

The present invention relates to a sealing device between two cavities at different pressures, for example, in an internal combustion engine fuel injector.

Known injectors normally comprise a hollow body carrying the nozzle; and a cavity at atmospheric pressure, in which slides a control rod for controlling the nozzle. The rod is controlled hydraulically by a metering valve comprising a valve body with a control chamber supplied with fuel under pressure.

The valve body of known injectors is substantially cylindrical, is housed inside a cylindrical seat in the hollow body, has an annular cavity for distributing fuel to the control chamber, and is therefore also subjected to high pressure and must be connected to the hollow body by a sealing device between the annular cavity and the cavity at atmospheric pressure.

For this purpose, provision is made, between the cylindrical wall of the valve body and the seat in the hollow body, for at least one annular seal, which normally rests on a shoulder of the seat, and is normally so sized that, when fitted to the valve body, it is stretched slightly to effectively seal the surface of the valve body. For technical reasons, the valve body has a 5 to 35 micron radial clearance with respect to the seat.

During operation of the injector, the high fuel pressure of around 1350 bar in the distribution cavity tends to force the seal inside the gap between the valve body and the seat, i.e. the seal is extruded inside the gap, thus resulting in the formation of extrusion rings and deterioration of the seal. As a result, the high-pressure fuel leaks increasingly through the extrusion rings, thus reducing the difference in pressure and generating heat due to leakage friction; which heat further impairs the resistance of the seal, which begins fraying and must therefore be changed frequently.

SUMMARY OF THE INVENTION

It is an object of the present invention to provide a sealing device for an injector of the above type, which is easy to assemble, is of long working life, and provides for eliminating the aforementioned drawbacks typically associated with known sealing devices.

According to the present invention, there is provided a sealing device between two cavities at different pressures, and which comprises an annular seal between two concentric surfaces separating said cavities; characterized in that said seal is compressed between two shoulders provided on said surfaces in a direction parallel to their axis, so as to seal both said surfaces and said shoulders.

The device is advantageously fitted inside an internal combustion engine fuel injector comprising a hollow body carrying a nozzle, and a metering valve for opening said nozzle, said metering valve having a valve body housed inside a cylindrical seat of said hollow body, and is characterized in that said shoulders are provided on the surface of said cylindrical seat and on the outer surface of a portion of said valve body.

BRIEF DESCRIPTION OF THE DRAWINGS

A preferred non-limiting embodiment of the present invention will be described by way of example with reference to the accompanying drawings, in which.

DETAILED DESCRIPTION OF THE INVENTION

Figure 1:
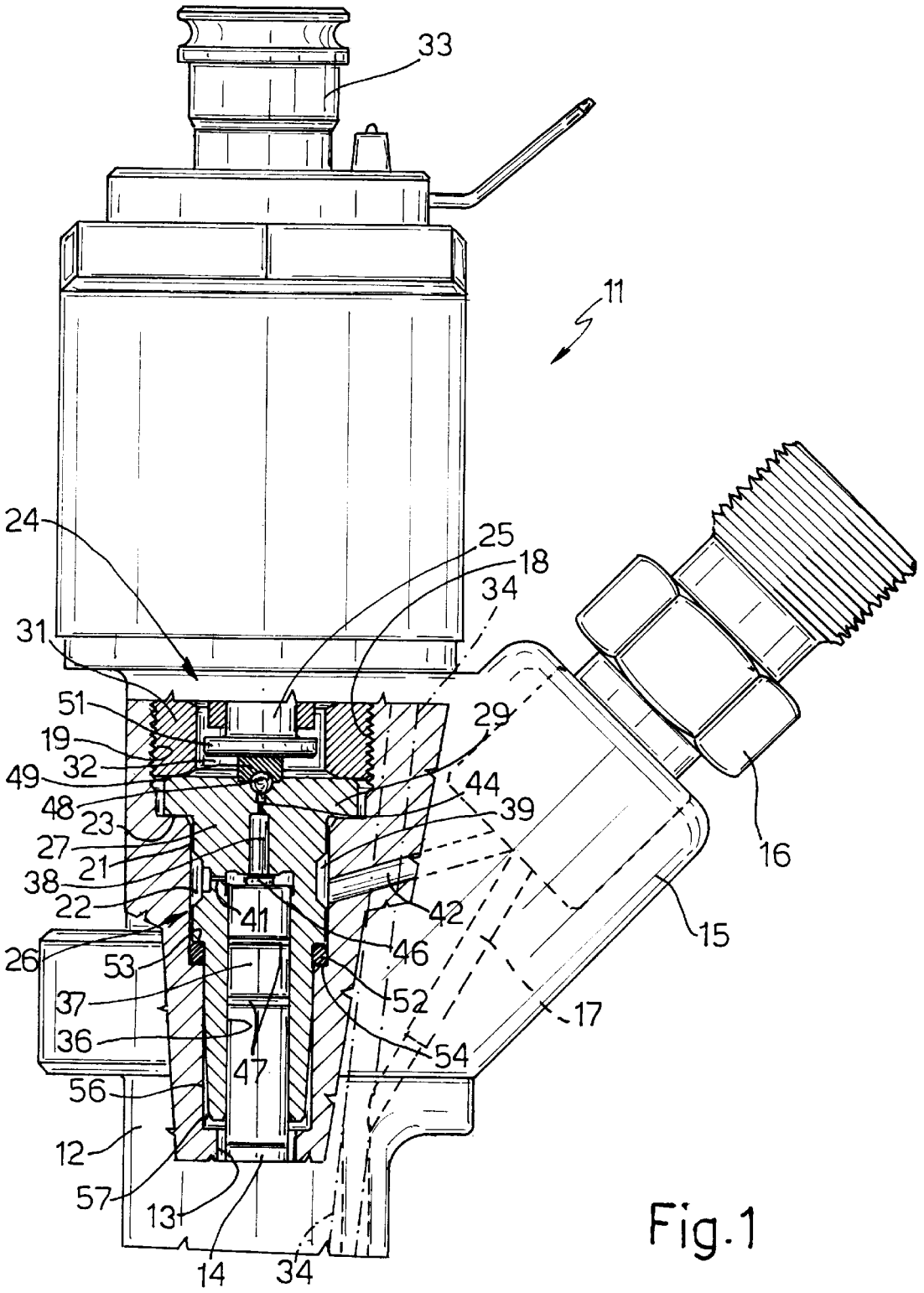
FIG. 1 shows a partial section of a fuel injector incorporating a sealing device in accordance with the invention.

Number 11 in FIG. 1 indicates as a whole a fuel injector, e.g. for an internal combustion engine. Injector 11 comprises a hollow body 12 carrying a nozzle (not shown) terminating at the bottom with one or more injection orifices. Body 12 has an axial cavity 13 in which slides loosely a control rod 14 connected to a pin for closing the injection orifice; and an appendix 15 in which is inserted an inlet fitting 16 connected to the usual fuel supply pump supplying fuel at a high pressure of, say, 1350 bar.

Body 12 comprises a conduit 17 connecting fitting 16 to an injection chamber of the nozzle; a substantially cylindrical cavity 18 with a thread 19; and a seat 21 in turn comprising a cylindrical surface 22 separated from cavity 18 by a shoulder 23. Injector 11 also comprises a metering valve, indicated as a whole by 24, which is housed inside seat 21 and is controlled by the stem 25 of the armature of an electromagnet (not shown).

Figure 2:
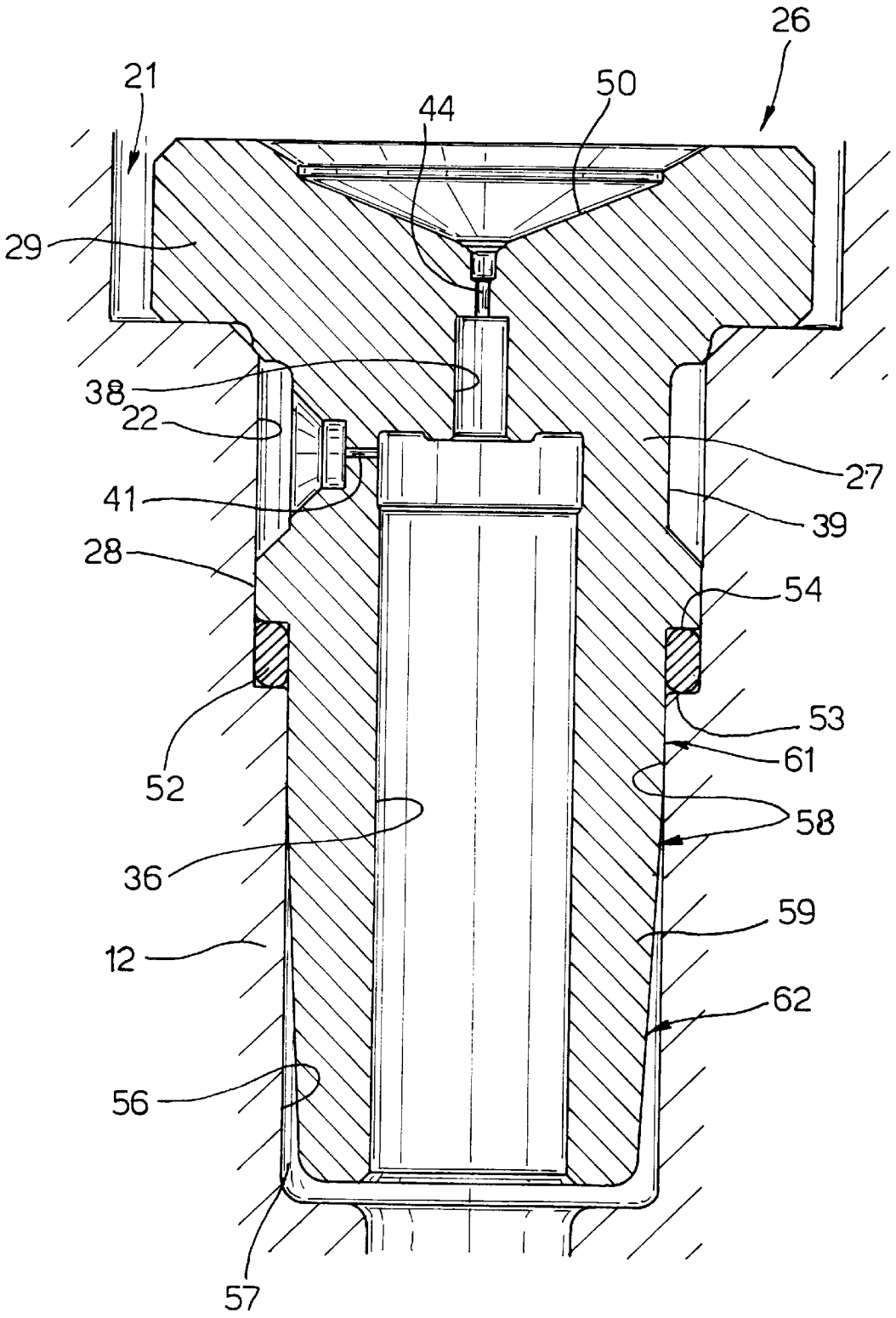
FIG. 2 shows a larger-scale portion of FIG. 1.

Metering valve 24 comprises a valve body 26 having a portion 27 with a substantially cylindrical outer surface 28 (FIG. 2); and valve body 26 also has a flange 29 normally held contacting a rest portion or shoulder 23 (FIG. 1) of hollow body 12 by an externally-threaded ring nut 31 screwed to thread 19 of cavity 18.

The gap between ring nut 31 and stem 25 defines a discharge chamber 32 of valve 24; chamber 32 communicates in known manner with a discharge fitting 33 connected to the fuel tank, so that the fuel in chamber 32 is substantially at atmospheric pressure; and cavity 13 of hollow body 12 communicates with discharge fitting 33 via a discharge conduit 34 formed in body 12, and is therefore also at atmospheric pressure.

Valve body 26 has an axial hole 36 in which is guided a top portion 37 of rod 14, and an axial control chamber 38 communicating with hole 36; and portion 27 of valve body 26 has an annular groove 39 communicating with the end portion of hole 36 via a calibrated conduit 41 defining the inlet conduit of control chamber 38.

Hollow body 12 has a further conduit 42 connecting fitting 16 to annular groove 39, which acts as a distribution cavity for distributing fuel from conduit 42 to control chamber 38, and therefore normally contains fuel at high pressure.

Control chamber 38 has a calibrated discharge conduit 44 communicating with discharge chamber 32; the end of the top portion 37 of rod 14 has an appendix 46 for cutting off communication between hole 36 and chamber 38 without closing inlet conduit 41; and portion 37 of rod 14 has two annular seals 47 for preventing the passage of fuel from control chamber 38 to axial cavity 13.

The pressure of the fuel in hole 36 normally keeps rod 14 in the lowered position closing the nozzle of injector 11; discharge conduit 44 of control chamber 38 is normally kept closed by a shutter in the form of a ball 48, which rests on a conical seat 50 (FIG. 2) defined by the contact surface with conduit 44; and ball 48 (FIG. 1) is guided by a guide plate 49 on which acts a flange 51 of armature stem 25.

Since distribution cavity 39 normally contains high-pressure fuel, while cavity 13 and discharge chamber 32 contain fuel at atmospheric pressure, the region of cavity 39 must be isolated hydraulically from both cavity 13 and chamber 32 by an effective sealing device. Sealing between cavity 39 and discharge chamber 32 is ensured in known manner by flange 29 contacting shoulder 23, and by ring nut 31 contacting flange 29.

According to the invention, the sealing device between high-pressure cavity 39 and atmospheric-pressure cavity 13 comprises a circular- or oval-section annular seal 52 made of elastomeric material, e.g. Teflon (registered trademark) with the addition of glass or bronze fibers, and which is compressed in a direction parallel to the axis of the cylindrical seat between two shoulders 53, 54.

More specifically, shoulder 53 (FIG. 2) is provided on seat 21 of valve body 26, and separates cylindrical surface 22 from a cylindrical surface 56 of a portion 57 of the seat and smaller in diameter than surface 22. The other shoulder 54 is provided on the outer surface 28 of portion 27, and separates surface 28 from a surface 58 of another portion 59 of valve body 26 and also smaller in diameter than surface 28.

The two shoulders 53, 54 are therefore annular, coaxial and parallel to each other. Shoulder 54 is so located beneath cavity 39 that, when ring nut 31 brings flange 29 into contact with shoulder 23 of body 12, shoulder 54 compresses seal 52 axially so as to deform and bring it into sealing contact, not only with shoulders 53 and 54, but also with surface 22 of seat 21 of hollow body 12, and with surface 58 of portion 59 of valve body 26, thus providing for excellent sealing of both seat 21 and valve body 26 by seal 52.

To simplify fitment of seal 52 to valve body 26, portion 59 comprises a cylindrical portion 61 (FIG. 2) and a slightly truncated-cone-shaped portion 62. More specifically, cylindrical portion 61 is of a height equal to roughly a quarter of the height of portion 59, while truncated-cone-shaped portion 62 is of a height equal to roughly three-quarters of portion 59.

Metering valve 24 (FIG. 1) of injector 11 is assembled as follows.

First of all, seal 52 is fitted to portion 59 so as to contact shoulder 54; body 26 of valve 24, together with seal 52, is inserted inside seat 21 of hollow body 12, and rod 14 inside hole 36; and ring nut 31 is screwed to thread 19 to force flange 29 against shoulder 23 and so deform seal 52, which assumes a substantially rectangular section to fill the annular gap between the two shoulders 53 and 54.

Injector 11 operates in known manner as described briefly below.

When the electromagnet is energized, stem 25 of the armature is raised; the pressure of the fuel in control chamber 38 opens metering valve 24, so that rod 14 is raised to open the nozzle of injector 11; and the fuel in chamber 38 is discharged into the tank via chamber 32 and fitting 33.

When the electromagnet is de-energized, a spring (not shown) lowers stem 25 and pushes ball 48 against conical seat 50 (see also FIG. 2) to close valve 24; and the pressure of the fuel in control chamber 38 increases rapidly to lower rod 14 and so close the nozzle of injector 11.

As compared with known devices, the advantages of the sealing device according to the invention will be clear from the foregoing description. Compressing seal 52 between the two shoulders 53, 54 provides for redundant sealing between seat 21 of hollow body 12 and portion 59 of valve body 26, thus preventing extrusion rings being formed in the material of seal 52. Moreover, improving the efficiency of seal 52 reduces fuel leakage and, therefore, friction-induced heating to increase the working life of seal 52.

Clearly, changes may be made to the sealing device as described and illustrated herein without, however, departing from the scope of the accompanying claims. For example, seal 52 may be made of different elastomeric material; and the device may comprise more than one annular seal.

What is claimed is:

1. In a fuel injector, a sealing device between two cavities of said injector at different pressures, said cavities being provided in an hollow body having a seat for housing a valve body, said seat and said valve body having two coaxial surfaces separating said cavities, said valve body having a flange portion contacting a rest portion of said hollow body by the action of a threaded ring nut, said device comprising an annular seal compressed between two shoulders provided on said two surfaces in a direction parallel to the axis of said two surfaces, so as to seal both said surfaces and said two shoulders.

2. In a fuel injector for internal combustion engines, comprising a hollow body carrying a nozzle, and a metering valve for opening said nozzle, said metering valve having a valve body housed inside a seat of said hollow body, said valve body and said seat having two coaxial surfaces separating two cavities at different pressures, a sealing device between said two cavities comprising an annular seal compressed between two shoulders provided on said two surfaces in a direction parallel to the axis of said two surfaces, so as to seal both said surfaces and said shoulders.

3. A device as claimed in claim 2, characterized in that said seal (52) has a substantially circular section; said valve body (26) being connected to said hollow body (12) by a threaded ring nut (31), which is screwed inside a thread (19) of said hollow body (12) to so deform said section as to seal both said surface (22) of said cylindrical seat (21) and said outer surface (58).

4. A device as claimed in claim 3, wherein said valve body (26) has a flange (29) against which said ring nut (31) acts; said flange (29) being arrested against a further shoulder (23) of said hollow body (12); characterized in that an end portion (62) of said valve body (26) is slightly truncated-cone-shaped to assist insertion of said valve body (26) inside said cylindrical seat (21).

5. A device as claimed in claim 4, wherein said valve body (26) has a compression chamber (38), which communicates with a discharge chamber (32) via a discharge conduit (44), and has a high-pressure-fuel inlet conduit (41) to act on a rod (14) controlling the injector (11); said discharge conduit (44) being controlled by an electromagnetically controlled shutter (48); and said inlet conduit (41) being located radially at said cavity (39); characterized in that the shoulder (54) of said valve body (26) is located between said cavity (39) and said truncated-cone-shaped end portion (62).

* * * * *